United States Patent [19]

Ayers

[11] Patent Number: 4,808,197

[45] Date of Patent: Feb. 28, 1989

[54] QUENCH RING FOR A GASIFIER

[75] Inventor: Harold J. Ayers, Woodlands, Tex.

[73] Assignee: Texaco Inc., White Plains, N.Y.

[21] Appl. No.: 100,672

[22] Filed: Sep. 24, 1987

[51] Int. Cl.[4] ..... C10J 3/48

[52] U.S. Cl. ..... 48/69; 48/77; 48/DIG. 2; 110/171

[58] Field of Search ..... 48/69, DIG. 2, 128, 48/63, 64, 76, 77; 422/207; 110/171; 55/244, 256, 257 MP

[56] References Cited

U.S. PATENT DOCUMENTS 4,218,423 8/1980 Robin et al. ..... 48/69

4,444,726 4/1984 Crotty et al. ..... 48/69

*Primary Examiner*—Peter Kratz

*Attorney, Agent, or Firm*—Robert A. Kulason; James J. O'Loughlin; Robert B. Burns

[57] ABSTRACT

A gasifier for producing a usable gas by combusting a particulated carbonaceous fuel in a combustion chamber which is communicated to a cooling zone. A dip tube conducts an effluent flow of gas and slag to the bath by way of an upright guide passage. A segmented quench ring communicated with a pressurized source of a liquid coolant such as water, directs a flow thereof against the dip tube guide surfaces to maintain the latter in a wetted condition. The respective segments of the manifolded quench ring are supported in a manner to cooperate with each other, yet to maintain lateral interspacing therebetween. A shield disposed across the interspace permits the latter to adjust in response to thermal expansion and contraction of the respective ring or manifold segments.

7 Claims, 2 Drawing Sheets

QUENCH RING FOR A GASIFIER

BACKGROUND OF THE INVENTION

In the production of a usable gas by the combustion, or partial oxidation of a carbonaceous fuel, the process is operated most effectively under a high temperature and high pressure conditions. For example, for the production of a gas from a particulated coal or coke, a preferred operating temperature range of about 2400° to 2600° F. is maintained, at a pressure of between about 5 to 250 atmospheres.

The harsh operating conditions prevalent in such a process, and in particular the wide temperature variations experienced, imposes a severe strain on many segments of the gasifier or reactor unit. The effect on metallic parts is most noticeable.

The present invention is addressed to an improvement in the structure of a gasifier, and particularly to the quench ring and the dip tube structure. The latter, by their functions, are exposed to the maximum temperature conditions by virtue of the hot product gas which comes in contact with these members directly from the combustion chamber.

U.S. Pat. No. 4,218,423, issued Aug. 19, 1980 to Robin et al., illustrates one form of quench ring and dip tube which can be improved through use of the present arrangement. The industry, however, has experienced a chronic defect in gasifier construction due to the physical stress imposed on the quench ring as a result of the quench ring's proximity to the hot gas, as well as to the flow of liquid coolant which it conducts.

These difficulties, experienced as a result of high temperature conditions, generally manifest themselves in the form of minute cracks and fissures which develop in the quench ring. The latter tend to form in areas where sharp corners are present such that any physical or thermal stress would be magnified.

Further, the toroidal configuration of the usual quench ring, often prompts the development of strains due to the thermal expansion and contraction of the ring.

Toward overcoming this prevalent operating defect in gasifiers of the type contemplated, there is presently disclosed a combination dip tube and quench ring. The latter are so positioned and interrelated to minimize the thermal stresses normally encountered during a gasification process. Further, the water carrying quench ring is segmented into a plurality of members which are cooperatively arranged in a circular configuration, having shielded water cooled expansion joints between the respective segments.

It is therefore an object of the invention to provide an improved gasifier for producing a usable gas, in which the dip tube is wetted by a coolant holding quench ring.

A further object is to provide a liquid cooling system for a gasifier, which system minimizes thermally induced stresses in the quench ring due to high temperature expansion realized as a result of contact with hot produced gas conducted from the gasifier's combustion chamber.

A still further object is to provide a gasifier cooling system wherein a novel liquid holding, segmented quench ring is positioned to cool the dip tube while minimizing internal thermal stress.

Figure 1:
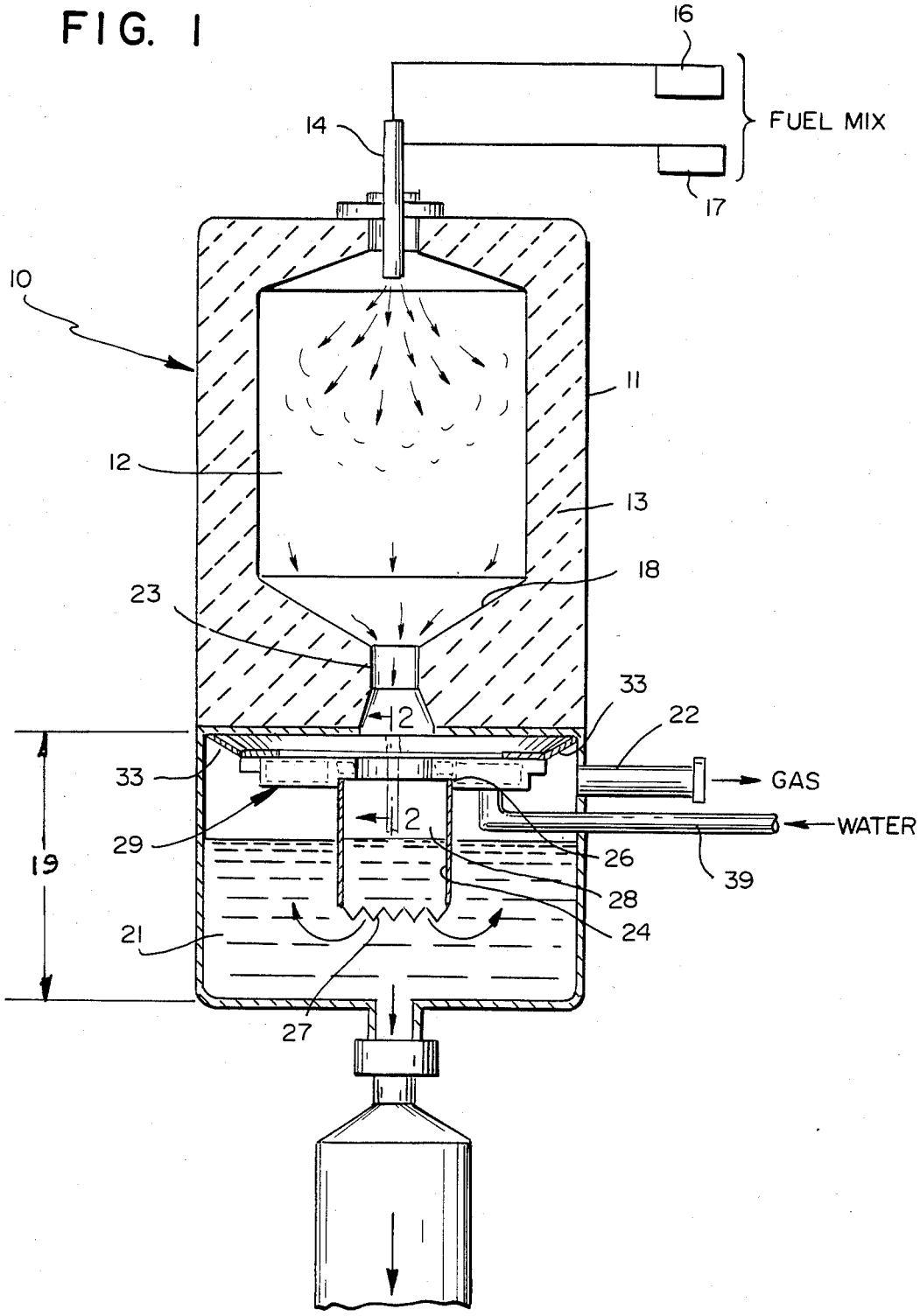
FIG. 1 is an elevation view in cross-section of a gasifier presently contemplated.

Stated briefly, in achieving these objectives, and referring to FIG. 1, there is provided a gasifier or reactor for partially combusting a carbonaceous fuel either solid or liquid. The reaction will produce a useful gas and a hot effluent, normally in the form of particulated ash and gas. The gasifier or reactor is embodied in an insulated, refractory lined shell which is positioned uprightly to form a downflow stream of hot produced gas.

A combustion chamber within the shell receives a pressurized stream of fuel mixture from a fuel injection burner. The latter is communicated to a source of the carbonaceous fuel, as well as to a source of combustion supporting gas such as oxygen or air. The mixture can advantageously be injected as a liquid slurry.

The hot products of combustion generated in the combustion chamber are passed through a constricted throat in the gasifier shell to be cooled in a quench chamber holding a liquid bath.

To facilitate passage of effluent gas from the reactor throat, a dip tube guides the hot products into the bath. The dip tube, positioned in a generally upright orientation, cooperates with a segmented quench ring. The latter receives and directs a stream of liquid coolant such as water along the dip tube exposed guide face, concurrently with impingement of hot product gas thereagainst.

Referring again to FIG. 1, a gasifier or reactor 10 of the type presently contemplated embodies an elongated metallic shell 11. The latter is normally operated in an upright or vertical disposition. The shell includes a combustion chamber 12 at the upper end. To withstand the high operating temperatures (2400° to 2600° F.) experienced during the gasification process, combustion chamber 12 is provided with an insulated inner wall 13 formed of a high temperature resistant refractory material.

A fuel injecting burner 14 is positioned at the shell 12 roof or upper end to inject the carbonaceous fuel mixture, from a source 16 into combustion chamber 12. The fuel as noted, will be introduced together with an amount of a combustion supporting gas such as oxygen or air, from a pressurized source 17.

The invention can be applied to gasifiers capable of burning a variety of carbonaceous fuels. To illustrate the apparatus and the disclosed novel quench ring, it will be assumed that burner 14 is communicated with a source 16 of coke. The solid fuel has been ground to a desired mesh and formed into a slurry by the addition of a sufficient amount of water. The pressurized gas at source 17 is assumed to be oxygen.

The bottom of combustion chamber 12 is defined by an insulated floor 18 which converges inwardly. This shape enhances the discharge of both solid and gaseous products which have been produced in combustion chamber 12, as well as liquid slag.

The lower end of shell 11 encloses a quench chamber or cooling zone 19 into which the hot products of combustion are directed. In the latter they contact a liquid coolant bath 21 normally comprised of water, which, although not shown, can be recirculated and cooled.

Subsequent to the gaseous segment of the combustion products being cooled in bath 21, it is passed through a discharge opening 22 in shell 11. It can then be further processed in downstream equipment and operations.

Combustion chamber 12 and the cooling zone or quench chamber 19 are communicated through a constricted throat 23 formed in the combustion chamber lower floor 18. To achieve greater cooling efficiency to the effluent flow, quench chamber 19 is provided with a generally cylindrical dip tube 24 having an upper edge 26 positioned adjacent to constricted throat 23. Dip tube 24 further includes a lower edge 27 which terminates beneath the surface of bath 21.

Dip tue 24 is supported within quench chamber 19, such that the dip tube's inner cylindrical wall defines a guide passage 28 for hot gas as well as for other hot products leaving throat 23. As the high pressure gas stream is introduced to water bath 21, it will be substantially reduced in temperature as it bubbles up and flows through discharge port 22.

As is known in the prior art, the flow of gas along dip tube 24 which forms gas guide path 28, can be facilitated, and thermal damage to the dip tube minimized by providing the latter along its gas contacting face with a constant film of water. A pressurized stream of the latter is thereby introduced to the dip tube 24 upper end and permitted to flow downward along its inner wall and to drain into bath 21.

The prior art has dealt with the concept of an effluent guiding dip tube, as well as with means for continuously wetting the contact or guide surfaces of the latter. However, and as herein noted, the high temperature of the produced gas which leaves constricted throat 23, can be harmful to the structure. Most pointedly affected in this respect is quench ring 29 which is fixedly positioned adjacent to dip tube 24.

In the present arrangement, dip tube 24 is supported in a generally vertical disposition having the upper edge 26 nearest to, and preferably coaxial with constricted throat 23. Support of dip tube 24 can be through a circular bracket or series of brackets or support members 33 which depend from the wall of shell 11, or which can depend downwardly from the floor 18 of combustion chamber 12.

Figure 2:
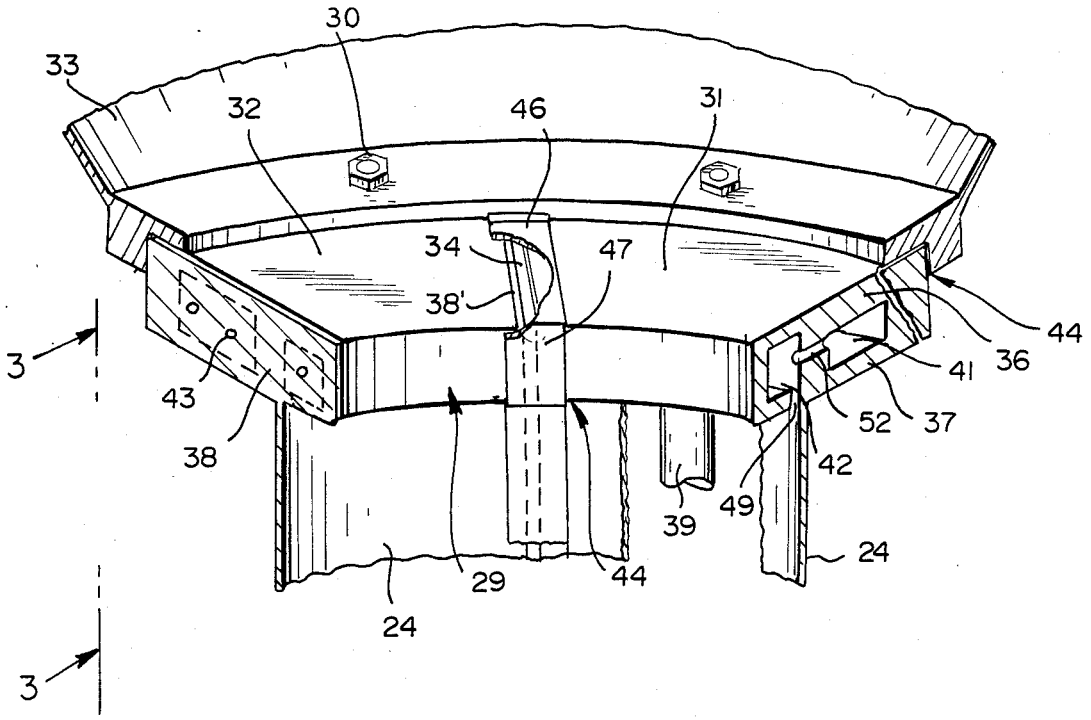
FIG. 2 is an enlarged segmentary view from FIG. 1.

Preferably, quench ring 29, will assume a generally toroidal configuration as shown in FIG. 2. Thus, the quench ring can be fabricated in the form of a relatively thin walled steel manifold which is capable of conducting a coolant flow and of concurrently supporting dip tube 29.

Referring to FIG. 2, segmented quench ring 29 is formed as noted, in a generally toroidal configuration comprised of a plurality of discrete ring or manifold segments such as 31 and 32. The respective ring segments are independently mounted to one or more support bracket 33, by fasteners 30. Said support brackets extend outwardly and are fastened at their periphery to the gasifier shell 11 wall. Each pair of adjacent ring segments 31 and 32, when in cold condition, defines a common radial expansion space or interspace 34 therebetween.

Each quench ring segment, such as 31, is comprised of a metallic weldment body having an upper wall 36 and a lower wall 37. Oppositely positioned end panels 38 and 38' define a distribution or inlet chamber 41 and a second or discharge chamber 42. The latter are communicated through at least one transverse passage 52.

Functionally, inlet chamber 41 is communicated to a pressurized source of coolant water by a series of peripherally spaced conduits 39. Passage 30 conducts water into discharge chamber 42, from which it is directed against dip tube 24 by way of constricted circular outlet port 49.

When gasifier 10 is not operating to produce gas, and the temperature in quench chamber 19 is sufficiently low, expansion space 34 will be at a minimum width. However, as the gasification process proceeds, combustion chamber 12 will be heated to operating temperature on the order of 2400° to 2600° F. The hot effluent in turn will heat the quench chamber 19, exposing quench ring 29 to the elevated temperature. This exposure will cause the ring to thermally expand outwardly. Thus, the diameter of the segmented quench ring will not only increase, but the space 34 between adjacent segments will progressively lessen. This decrease could be to the point where the respective segments could be in contact. Preferably, space or opening 34 will be maintained regardless of the elevated temperature within quench chamber 19.

Each end of a ring segment body is provided with oppositely positioned closure panels 38 and 38' which form a water holding inlet or first chamber 41, and the adjacent secondary or discharge chamber 42. To minimize thermal expansion of the respective ring segments at least one end panel 38 and preferably both end panels, are provided with one or more vent holes 43. The latter are directed to impinge coolant water against the surface of the adjacent end panel of the contiguous ring segment. Both the first and secondary chambers 41 and 42 are provided with vent holes such that the entire side of each ring segment will be subjected to cooling by liquid impingement.

As noted, during both the heating period and the actual operating period when temperature is at a maximum within combustion chamber 12, segmented quench ring 29 will expand. The interspace 34 between adjacent ring segments is thus provided with shield 44 to form a moving or adjustable barrier to entry of either gas or slag into the interspace 34.

The space between the two adjacent ring segments 31 and 32 is thus provided with a cover plate on shield 44 to form a substantial barrier to unimpeded entry of either gas or slag into the interspace 34.

Entry of slag particulates would tend to create a situation that would prevent the desired controlled relative movement between the respective ring segments 31 and 32. Shield 44 in one embodiment thus includes primarily an elongated metallic strip which is shaped to conform to the contour of the quench ring 29 upper surface. Thus, a horizontal portion 46 of shield 44, while fixed to one of the ring segments 31, overlies and slidably engages the corresponding upper surface of the adjacent segment 32. Similarly, a vertical segment 47 of shield 44 is shaped to protect the exposed lateral faces of the quench ring segments as well as the underlip of the latter.

Shield 44 as noted, extends backwardly along the upper surface of the ring segment 31. The shield thereby functions as a movable upper barrier to the varying width interspace 34 into which liquid coolant is injected. This will control or minimize expansion of the adjacent ring segments and prevent them from coming into heat exchange contact.

In a further embodiment of the invention, while not constituting a persistent operating problem created as a result of thermal expansion of the quench ring 29, dip tube 24 can similarly be divided. Such dip tube sections, when cooperatively arranged, define guide passage 28 for downflowing hot effluent. In such an instance, an interspace shield can be extended downwardly to close the space between the edge of the respective dip tube sections.

Figure 3:
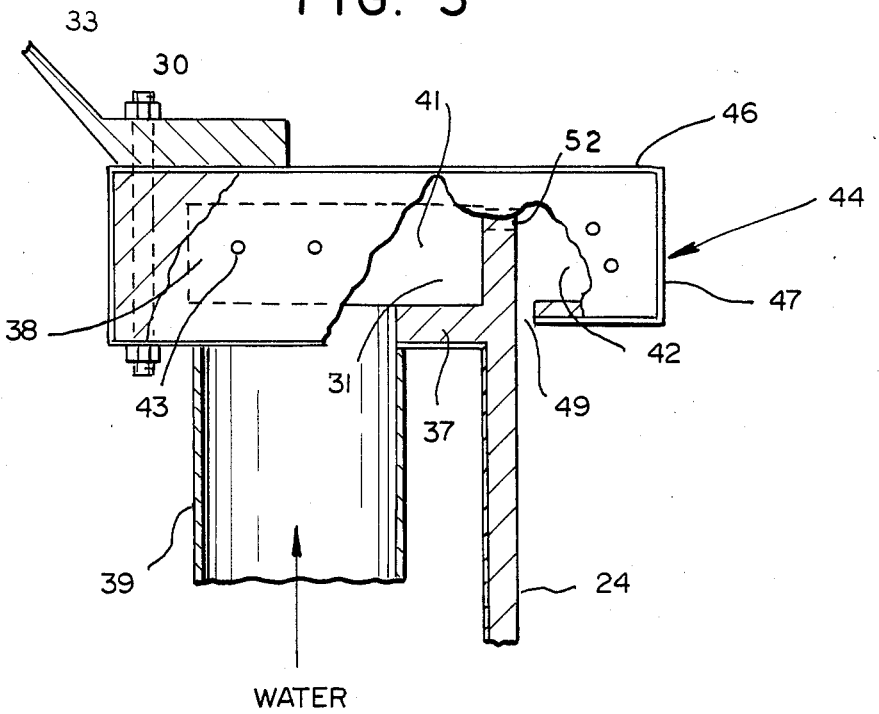
FIG. 3 is a cross-sectional view taken along line 3—3 in FIG. 1.

Structurally, and as seen in FIG. 3, the dip tube can be supported by and made integral with the quench ring segment body. As here shown, the liquid coolant flow can be readily directed through constricted circular opening 49, against the dip tube inner or exposed face.

It is understood that although modifications and variations of the invention can be made without departing from the spirit and scope thereof, only such limitations should be imposed as are indicated in the appended claims.

I claim:

1. In a gasifier for producing a usuable gas by partial combustion of a carbonaceous fuel, a gasifier shell defining combustion chamber therein, and a burner for injecting said carbonaceous fuel therein, means forming a cooling zone in said shell beneath said combustion chamber, holding a water bath, means forming a throat communicating the combustion chamber with said means forming said cooling zone, a dip tube defining a flow path for guiding a hot effluent stream comprised of produced gas and particulated ash from said means forming said throat into said bath, and a quench ring supportably positioned above said diptube, the improvement wherein said quench ring is comprised of, a plurality of discrete manifold segments cooperatively positioned in a circular arrangement to define an annular effluent passage, each discrete manifold segment having an edge spaced laterally from an adjacent manifold segment edge to define an interspacial void there between, each said manifold segment having means forming an internal chamber communicated with a source of liquid coolant, and having a discharge port aligned with said dip tube to direct said coolant liquid there against.

2. In the gasifier as defined in claim 1, including a shield depending from each discrete manifold segment overreaching an edge of the latter to operably engage an adjacent manifold segment, whereby to maintain a substantial barrier to the entry of effluent material into the interspatial void.

3. In the gasifier as defined in claim 1, including at least one support bracket depending from said shell and supportably engaging at least one of said plurality of manifold segments.

4. In the gasifier as defined in claim 1, wherein said dip tube depends downwardly from said quench ring to define said flow path for said, hot effluent stream.

5. In the gasifier as defined in claim 1 wherein said manifold segment means forming an internal chamber, includes means forming a primary chamber communicated with said source of a liquid coolant, means forming a secondary chamber communicated with said primary chamber, and means in said secondary chamber forming said discharge port.

6. In the gasifier as defined in claim 3 wherein each of said manifold segments includes a body depending from said support bracket, said means forming said primary chamber in said body communicated with said pressurized coolant source, and having opposed lateral panels disposed at each segment edge approximate to an adjacent segment edge.

7. In the gasifier as defined in claim 6, including vent passages formed in the respective opposed lateral panels for directing streams of coolant against the lateral panels of an adjacent manifold segment.

* * * * *